United States Patent [19]

Richter et al.

[11] Patent Number: 4,672,782

[45] Date of Patent: Jun. 16, 1987

[54] SMOKESTACK OR TOWER OF PRECAST REINFORCED CONCRETE MODULES

[76] Inventors: Georg-Gerd Richter, Treppenstrasse 9, D-6109 Muhltal 1, Fed. Rep. of Germany; Alfons O. Krautz, 10 Old Field Wood Rd., Old Field, N.Y. 11733

[21] Appl. No.: 588,307

[22] Filed: Mar. 12, 1984

[30] Foreign Application Priority Data

Dec. 2, 1983 [DE] Fed. Rep. of Germany ..... 3343721

[51] Int. Cl.[4] ..... E04H 12/28

[52] U.S. Cl. ..... 52/218; 52/433; 52/723

[58] Field of Search ..... 52/218, 244, 422, 723, 52/423–425, 433

[56] References Cited

U.S. PATENT DOCUMENTS

| | | | |
|---|---|---|---|
| 1069328 | 8/1913 | Griffin | 52/423 |
| 3,151,464 | 10/1964 | Sato et al. | 52/722 |
| 4,486,984 | 12/1984 | Carty | 52/218 |

FOREIGN PATENT DOCUMENTS

| | | | |
|---|---|---|---|
| 548860 | 11/1922 | France | 52/722 |
| 640012 | 2/1979 | U.S.S.R. | 52/218 |

*Primary Examiner*—Billy S. Taylor

*Attorney, Agent, or Firm*—Richard C. Conover

[57] ABSTRACT

A high, self-supporting smokestack or tower having a structure constructed by stacking precast reinforced concrete sections one upon the other, the cross-sectional area of the structure being larger at the bottom than at the top and concentrated reinforcement being provided along the length of the structure to bear the horizontal forces acting upon the smokestack or tower. The structure exhibits ribs provided with concentrated reinforcement and extending longitudinally on the outside of the structure at least along its lower portion, the radial extent of these ribs increasing from the top to the bottom at least so as to correspond essentially to the bending moment progression resulting from the horizontal stress. A mould device for producing precast reinforced concrete parts for such smokestacks or towers, in which mould sections are provided which are radially adjustable for fashioning the front surfaces of the ribs.

2 Claims, 8 Drawing Figures

SMOKESTACK OR TOWER OF PRECAST REINFORCED CONCRETE MODULES

Figure 1:
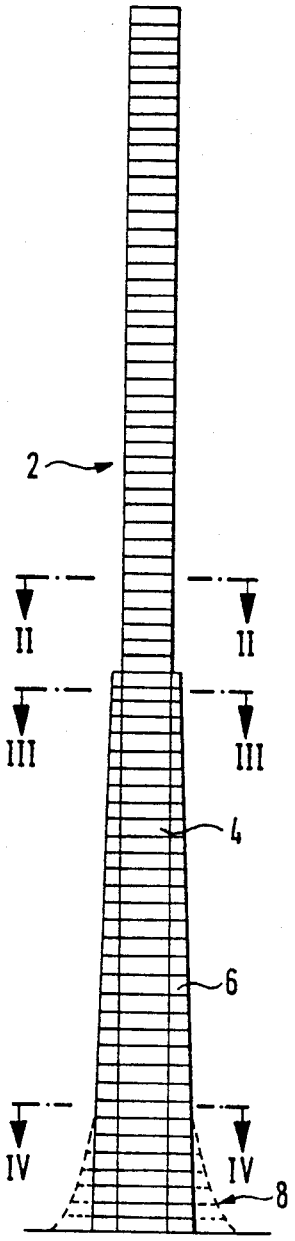

The invention relates to a high, self-supporting smokestack or tower having a structure constructed by stacking precast reinforced concrete sections one upon the other, the cross-sectional area of the structure being larger at the bottom than at the top and concentrated reinforcement being provided along the length of the structure to bear horizontal forces acting on the smokestack or tower.

A self-supporting smokestack with a structure constructed by stacking precast reinforced concrete sections one upon the other is known. The structure has been built with so-called "concentrated reinforcement" extending along the length thereof, the term "concentrated reinforcement" meaning that the reinforcing steel rods extending the length of the structure are not distributed more or less evenly throughout the cross-section of the structure, but concentrated at certain places on this cross-section, particularly in places of relatively high tensile load resulting from horizontal forces acting upon the smokestack. A self-supporting smokestack has also been built in which the cross-sectional area of the structure is larger at the bottom than at the top for improved acceptance of the load situation of the smokestack resulting from the horizontal forces acting upon it. However, consumption of concrte and reinforcing steel was very great, which naturally made this kind of smokestack fairly expensive.

The invention is based on the problem of providing a selfsupporting smokestack or tower of the type mentioned at the outset, which may be built so as to be very high and exhibit the necessary stability, iring relatively little material and involving relatively low costs.

This problem is solved according to the invention by providing the structure with ribs having concentrated reinforcement and extending longitudinally on the outside of the structure at least along its lower portion, the radial extent of these ribs increasing from the top to the bottom at least so as to correspond essentially to the bending moment progression resulting from the horizontal forces.

The phrase "at least along its lower portion" means that the ribs each extend from the base of the smokestack or tower up to a point where they end, located at the top of the smokestack or tower or somewhere between the top and the foot. This point is frequently located approximately half-way up the smokestack or tower.

This inventive design means that the steel rods acting as concentrated reinforcement on the ribs move radially towards the outside going from the top to the bottom along the structure, since the ribs become radially wider in this direction. Thus the bending moment, which increases from the top to the bottom, can be borne reliably with less material being used relative to known smokestacks.

According to the inventive principle, self-supporting smokestacks and towers can be built so as to be very high, in particular higher than 100 m, requiring a reasonable amount of material and reasonable costs. The term "structure" refers to the supporting structure of the smokestack or tower. Apart from the structure, a smokestack of precast parts generally exhibits, for example, one or more flues possibly stacked up in sections, thermal insulation between the flues and the structure in some cases, an inside climbing shaft perhaps, and so on. The structure usually consists almost exclusively of precast reinforced concrete sections stacked one upon the other, although in some cases it may be that the lowermost base portion of the smokestack, for example, where one or more exhaust flues are introduced into the flue, or the flues, or single areas located anywhere along the smokestack, are cast in poured-in-place concrete. The smokestack or tower generally exhibits at least three inventive ribs, since only two ribs involve a substantial reduction in the rigidity of the structure in one horizontal direction. Three, four, six or eight ribs are frequently provided. The preferred range for the number of ribs may be stated as being between three to twelve. The ribs are generally distributed over the outer periphery of the structure evenly or at least more or less evenly. The ribs are generally, in sections, part of each precast reinforced concrete section to be stacked one upon the other, and are cast in one piece with them. The channel for the concentrated reinforcement, or the channels for the concentrated reinforcements, in each rib preferably extend, when regarded from the top to the bottom, in such a way so as to be located further outside at the bottom than at the top, for example in such a way that they are at an essentially constant distance from the front surfaces of the ribs. However, an inner reinforcement channel may also extend, for example, vertically from the top to the bottom, and an outer reinforcement channel of the same rib be slightly curved or extend outwardly in a straight line. The outer front surfaces of the ribs may be vertical in each precast reinforced concrete section; in such a case the radial extent of the ribs increases along the structure step by step. However, the front surfaces of the ribs may also be slanted so as to be radially wider at the bottom than at the top in each precast reinforced concrete section; in such a case one can achieve a virtually continuous widening of the ribs along the structure. The inventive principle does not rule out that the radial width of the ribs increase from the top to the bottom more than corresponds to the bending moment progression resulting from the horizontal forces. This may be provided in particular at the foot of the smokestack or tower in order to obtain a transition to the foundation which responds better to stress. In the interests of saving a maximum of materials, however, an increase in the radial width of the ribs corresponding essentially to the bending moment progression resulting from horizontal forces is preferred.

The savings in materials and production costs aimed at by the invention may be obtained by providing the ribs provided with concentrated reinforcement, whose radial extent increases from the top to the bottom, only along the lower portion of the smokestack or tower, where the bending moment resulting from horizontal forces is particularly great. In the case of high and slender smokestacks or towers one must also consider the vibrations in the structure due in particular to gusts of wind, and guarantee that the structure is resistant to vibration. Vibratory stress is particularly great in the areas of vibration nodes. The inventive ribs are thus preferably carried out high enough to be present at the point of the highest vibration node of the structure. However, the inventive ribs may also cover more or less the entire length of the structure, thus saving material in the upper area of the structure as well.

The inventive design offers the possibility of designing the structure so as to include a shaft having a cross-section which remains constant from the top to the bottom, which is advantageous with respect both to production technology and to material consumption. The term "shaft" refers to the structure without the ribs. The shaft may also be designed, however, with a cross-section which increases from the top to the bottom, in particular in steps, the increase in the cross-section generally taking place on the outside, although not necessarily. This increase in the cross-section need not take place between each precast reinforced concrete section, but, for example, may be carried out regularly after a certain number of sections.

The shaft of the structure is also generally provided with concentrated reinforcements in the longitudinal direction. The concentrated rib reinforcements are preferably united with concentrated longitudinal reinforcements on the shaft at a certain height of the smokestack or tower in order to provide a particularly favorable introduction of stress into the concentrated rib reinforcements.

It has already been indicated above that the expected vibratory stress must also be taken into consideration particularly in the case of slender smokestacks or towers, i.e. those having a relatively small cross-section relative to their height. In a development of the invention, at least those precast reinforced concrete sections arranged in areas of maximum expected vibratory stress are designed with diagonal reinforcement, so that additional reinforcing steel rods, or reinforcing steel rods provided instead of the otherwise present vertical reinforcing steel rods, run on a slant relative to the horizol through such precast reinforced concrete sections. The maximum effect is obtained with diagonal reinforcements when they extend beyond the so-called "zero line", i.e. the vertical center line of the smokestack or tower, when regarded from the side. The term "diagonal reinforcement" means that the reinforcing steel rods are on a slant relative to the longitudinal axis of the structure, but not necessarily at an angle of 45°.

In order to connect the concentrated reinforcements of the structure with the precast reinforced concrete sections so that the forces are transmitted, the various precast reinforced concrete sections may each be provided with vertical reinforcement channels aligned with each other, into which reinforcing steel rods are inserted from the top, generally after several precast reinforced concrete sections have been stacked up, and in longitudinal sections to be connected together, each longer than the height of one precast reinforced concrete section. Subsequently, concrete is poured into the reinforcement channels. The transmission of forces between the concentrated reinforcements, which are generally connected with each other longitudinally throughout the entire length of the smokestack or tower, and the precast reinforced concrete sections may be improved in a preferred development of the invention by subsequently pouring in concrete to surround the concentrated rib and/or shaft reinforcements and form-fit the concrete of the precast sections via integrally cast anchoring projections. For this purpose, recesses, e.g. single spherical recesses, ring grooves, spiral grooves, etc., may be cast inside on the reinforcement channels during the production of the precast reinforced concrete sections. This may be achieved by mould elements with corresponding projections being inserted during casting of the precast reinforced concrete sections, these elements being removed towards the inside, after the concrete of the precast reinforced concrete sections has hardened, through the reinforcement channels thus moulded.

The invention further relates to a mould device for producing precast reinforced concrete parts having walling surrounding an axial inner passage and radially protruding ribs outside on the walling, in particular for producing precast reinforced concrete sections for a high, self-supporting smokestack or tower of the type described in general terms and in preferred developments above. The inventive mould device is intended to simplify the production of such precast reinforced concrete parts having ribs on the outside, in particular to allow for uncomplicated production of precast reinforced concrete parts having ribs of varying radial width.

For this purpose, the mould device is characterized according to the invention in that the mould device comprises an outer mould having first outer mould sections extending from the lateral surface of a rib to be produced, via the outside surface of a walling section to be produced, to the lateral surface of a further rib to be produced, the outer mould also having second outer mould sections each arranged between two adjacent first outer mould sections to fashion the front surfaces of the ribs, and that the second mould sections are provided so as to be radially adjustable, for example by means of a screw drive, a hydraulic cylinder or replaceable inserts.

As a result of this inventive design of the mould device, precast reinforced concrete parts having ribs of varying radial width may be cast without difficulty, the second mould sections being adjusted to the required radial position depending on the radial width of the rib to be produced. The second mould sections are generally each attached to the two adjacent first mould sections.

Preferably, the second mould sections are on a slant so as to approach each other in the axial direction, so that precast reinforced concrete parts with a radial rib width increasing from the top to the bottom may be cast without difficulty.

In the case of the inventive high, self-supporting smokestack or tower, the horizontal stress acting upon the structure is primarily due to wind pressure. There is also stress due to thermal expansion or contraction on one side, in particular in the case of insolation on one side, vibratory stress in particular due to gusts of wind, as mentioned above, and possibly stress due to earthquakes.

In the inventive high, self-supporting smokestack or tower the concentrated reinforcements in the structure and the ribs act as the supports of a reinforced concrete skeleton, whereas the precast reinforced concrete sections themselves have the function of horizontal reinforcing bars of great rigidity. Preferably, the ribs are cast in one piece with the precast reinforced concrete parts.

The invention also relates to the single precast reinforced concrete sections with which the smokestack or tower can be constructed. The reinforcement of the structure may be designed as loose or prestressed reinforcement.

The invention and the developments of the invention shall be described in more detail in the following with reference to preferred, non-restrictive embodiments. The figures show:

FIG. 1 a side view of a smokestack or tower

Figure 2:
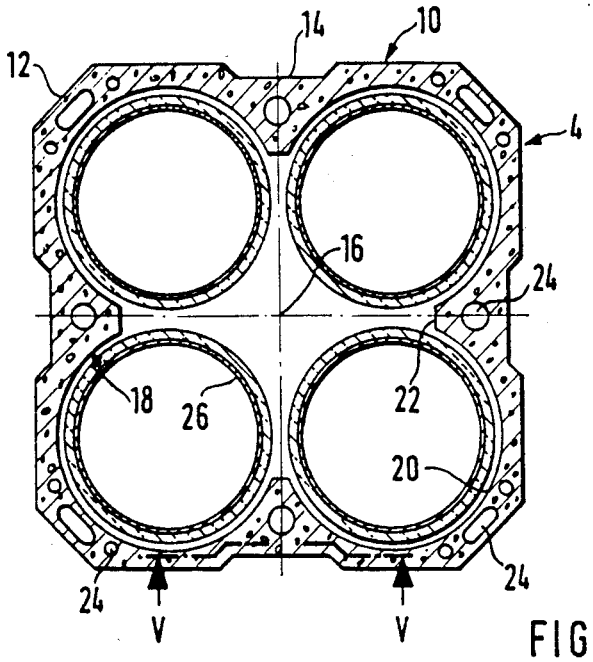

FIG. 2 a cross-section along II—II in FIG. 1, on an enlarged scale

Figure 3:
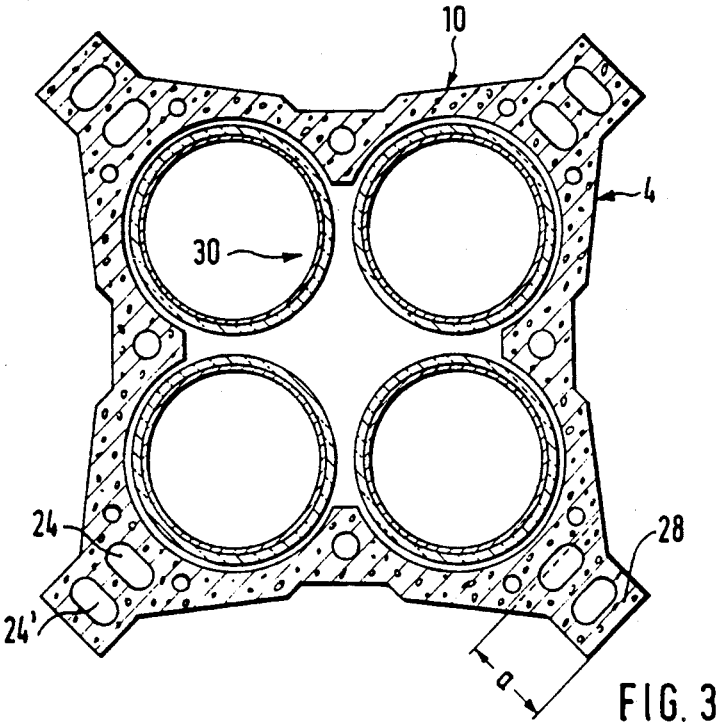

FIG. 3 a cross-section along III—III in FIG. 1 on the same scale as in FIG. 2

Figure 4:
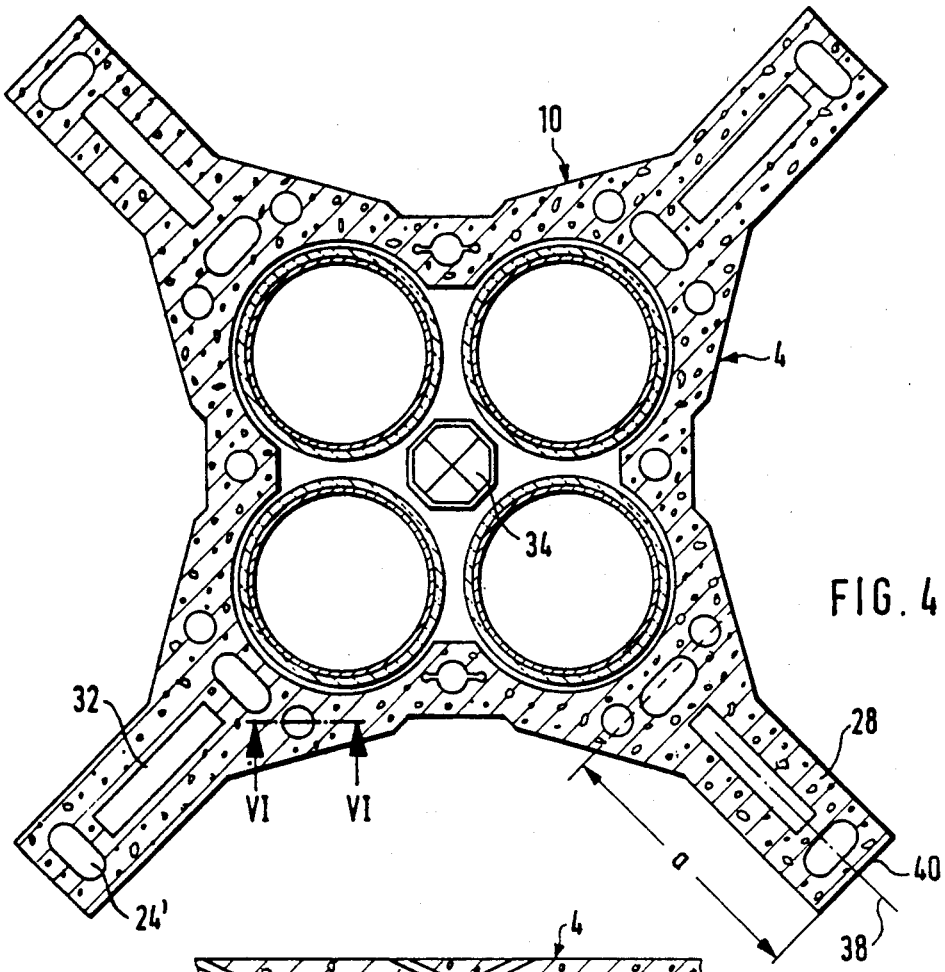

FIG. 4 a cross-section along IV—IV in FIG. 1 on the same scale as in FIG. 2

Figure 5:
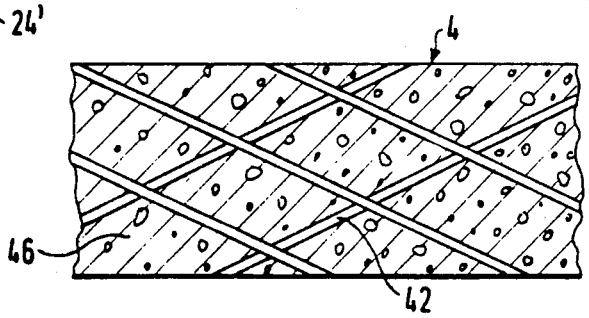

FIG. 5 a vertical partial section along V—V in FIG. 2

Figure 6:
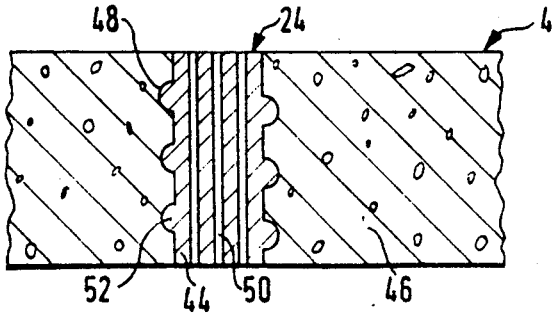

FIG. 6 a vertical partial section along VI—VI in FIG. 4

Figure 7:
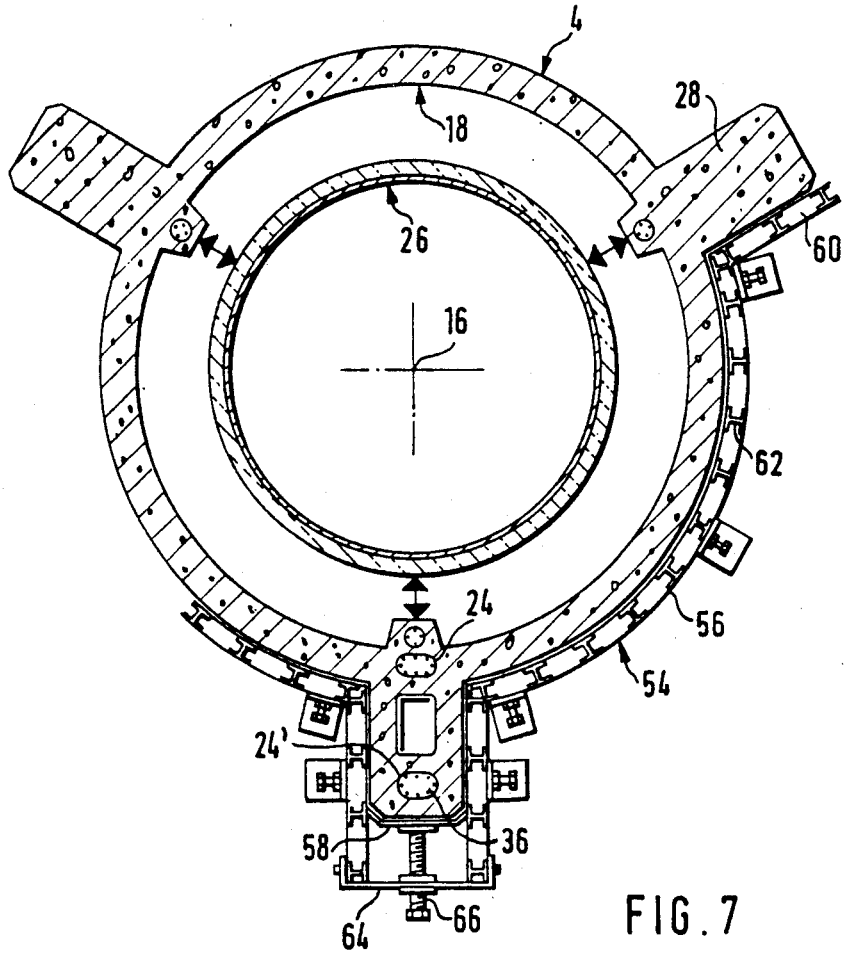
Figure 8:
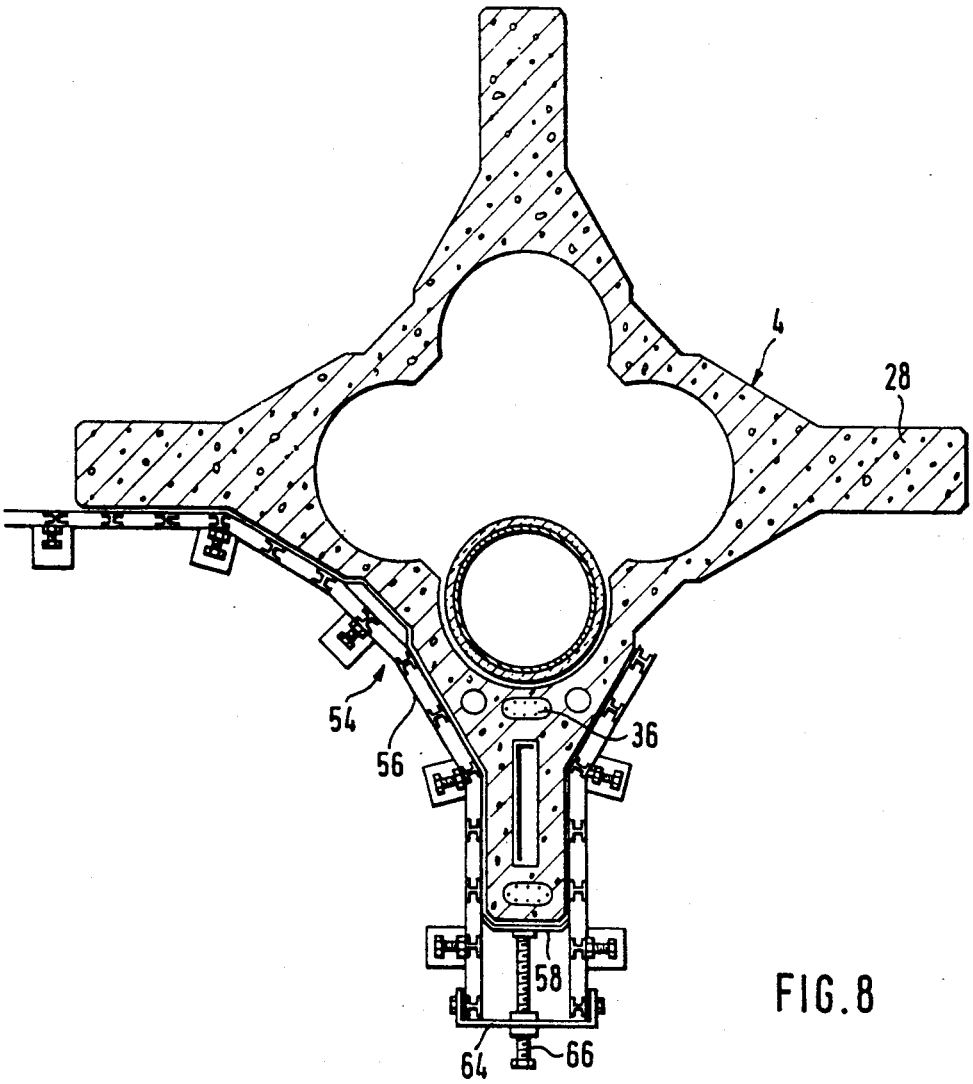

FIG. 7 a top view of a mould device for producing a precast reinforced concrete part with a round configuration and three ribs on the periphery for a smokestack or tower FIG. 8 a top view of a mould device for producing a precast reinforced concrete part for a smokestack or tower with a geometry differing from that of the mould device in FIG. 7

FIG. 1 shows a high, self-supporting smokestack or tower 2 constructed of precast reinforced concrete parts or sections, called "precast parts 4" in the following, stacked one upon the other. Smokestack or tower 2 is 150 m high, for example, and self-supporting. From the bottom towards the top about halfway up smokestack or tower 2, precast parts 4 are provided with ribs 6 projecting radially and extending longitudinally along smokestack or tower 2, as described in more detail below. The radial extent of ribs 6 increases gradually from precast part 4 to precast part 4 from the top towards the bottom, corresponding essentially to the bending moment progression resulting from the horizontal stress acting upon smokestack or tower 2. At base 8 of smokestack or tower 2 a number of precast parts 4 are provided in which the radial extent of the ribs increases gradually from the top towards the bottom more than corresponds to the bending moment progression.

FIG. 2 shows a precast part 4 from the upper half of smokestack or tower 2, without ribs. This precast part 4 has an approximately square outer periphery 10 with beveled corners 12 and a vertical groove 14 in the middle of each side. Number 16 refers to the upright axis of precast part 4. Inner periphery 18 of precast part 4 is designed in such a way that, symmetrically dividing up the cross-section of precast part 4, areas are formed each of which is limited on the outside by an arc 20 of about 220°. Arcs 20 are connected at sections 22 running parallel to the sides of outer periphery 10. Spaced a short distance towards the inside of beveled corners 12 and grooves 14 there are sixteen vertical reinforcement channels 24 altogether, some with a round configuration and some oval.

When designed in a smokestack 2, the four spaces bordered by arcs as described above each contain a smokestack flue 26 essentially comprising a vertical uninterrupted steel pipe and an insulating layer arranged on its outer side. The steel pipe is welded together of several sections which are normally as high as several precast sections 4. Flues 26 are supported on inner periphery 18 by spacers (not shown). Flues 26 are not in mutual contact; there is a free space directly between flues 26 and in particular around axis 16 in the middle of precast parts 4. The entire arrangement shown in FIG. 2 is completely symmetrical.

The precast element shown in its horizontal cross-section in FIG. 3 has a form typical for precast elements located somewhat below the middle of smokestack 2, i.e. in the area where precast parts 4 with radial ribs 28 of relatively less radial width a are provided. It may be seen in FIG. 3 that four ribs 28 distributed evenly over the periphery of precast part 4 are provided at the places where beveled corners 12 are located in precast parts 4 higher up (cf. FIG. 2). The areas of outer periphery 10 linking up with ribs 28 now extend to ribs 28 on a slight slant towards the outside, and are no longer parallel to each other as in precast part 4 as in FIG. 2. Oval reinforcement channels 24, which in precast part 4 as in FIG. 2 were close to the edge inside beveled corners 12, have now come somewhat further radially towards the outside, and there is an oval reinforcement channel 24' in addition inside each rib 28. In the inside 30 of precast part 4 nothing has changed in comparison to FIG. 2. In a precast part 4 arranged at a height of smokestack 2 between precast part 4 as in FIG. 3 and precast part 4 as in FIG. 2, corner reinforcement channels 24 and rib reinforcement channels 24' are united with each other, respectively.

Precast part 4 shown in FIG. 4 is located a fair way down smokestack 2. It can be seen that ribs 28 here have a much greater radial width a than in the case of precast part 4 as in FIG. 3. Rib reinforcement channels 24' have also moved towards the outside and are located in the radial end area of ribs 28. Further, radial hollows 32 are now present inside the ribs to save materials. In the center of inside 30 of precast part 4 one can see a device 34 providing a maintenance person with access to this point, for example, an elevator or a stairway.

The cross-section of reinforcement channels 24, 24' may increase from the top to the bottom, as can be seen by comparing FIGS. 2, 3 and 4. In precast part 4 as in FIG. 4, the areas of outer periphery 10 linking up with ribs 28 are slanted even more towards the outside, providing a more or less gradual transition from ribs 28 to the rest of precast part 4.

One proceeds as follows when building smokestack or tower 2 as in FIG. 1. First, the various precast parts 4 with the desired configuration are cast. The various precast parts 4 are then stacked up successively one upon the other. After several precast parts 4 have been stacked up, sections of suitable length of flues 26 and sections of suitable length of concentrated reinforcements 36 (cf. FIGS. 7 and 8) are inserted from the top and, as required, connected with flues 26 and concentrated reinforcements 36 linking up with them from below. Then concrete is filled into reinforcement channels 24 and 24'.

Apart from concentrated reinforcements 36 in reinforcement channels 24 and 24', the precast parts also have reinforcements not shown in the figures, distributed along the periphery and extending longitudinally on smokestack or tower 2, which have been integrally cast in concrete in the conventional manner during the production of precast parts 4. The term "concentrated reinforcement" means that, as opposed to the general reinforcement just described, bundles of reinforcing steel rods are present at a greater distance from each other than is usual in the case of conventionally distributed reinforcement.

The total number of stacked up precast parts 4, including ribs 28, general reinforcement of precast parts 4 and concentrated reinforcement 36 in reinforcement channels 24 and 24', is referred to as the structure of smokestack or tower 2 because this arrangement is the supporting component of smokestack or tower 2. By way of contrast, flues 26 in particular and other installations are not part of the structure. The entire number of precast parts 4 imagined without ribs 28 is referred to as the shaft of the structure.

In the embodiment described above, ribs 28 extend exactly radially in the sense that their longitudinal center plane 38 (cf. FIG. 4) points to center axis 16. This need not be the case; ribs 28 can also point outwardly at a different angle. The term "radially extending ribs" is intended to embrace all arrangements of ribs in which the ribs protrude outwardly from outer periphery 10 of precast parts 4.

Radial rib width a was shown in FIGS. 1 to 4 in such a way that it was measured from the point at which beveled corner 12 is located in a precast part 4 without ribs (cf. FIG. 2) to the extreme front end 40 of the rib 28. From this point of view, the areas of outer periphery 10 slanting outwardly as described above belong in part to rib 28, and corner reinforcement channels 24 further down smokestack or tower 2 are located in the base area of rib 28.

Typical dimensions of precast parts 4 are a height of 0.5 to 2.0 m, a width of the shaft without ribs 28 of 2 to 10 m and a radial rib width of 0 to 5 m.

FIG. 5 shows that reinforcing steel rods 42 may be provided extending on a slant, e.g. at an angle of about 30° to the horizontal, in precast parts 4 in order to bear in particular vibratory stress in the structure. Slanted, criss-crossing reinforcing steel rods 42 are provided in particular in the areas of vibratory nodes in the structure in addition to the longitudinal reinforcing steel rods of the general reinforcement of precast parts 4.

FIG. 6 shows how concrete 44 subsequently poured into reinforcement channels 24 or 24' meshes with and form-fits concrete 46 of the particular precast part 4. One can see spherical recesses 48 on the inner periphery of reinforcement channel 24 shown and reinforcing steel rods 50 extending longitudinally in reinforcement channel 24. Concrete 44 poured in subsequently flows into these recesses, hardening therein to form projections 52 which form-fit recesses 48 in a shrink-proof manner. Concrete 44 may be non-shrinking concrete.

FIG. 7 shows a mould device 54 for producing a precast part 4 having an essentially circular configuration with ribs 28 moulded on the outside. Further, for the sake of clarity, a single smokestack flue 26 is shown inserted concentrically in precast part 4, although it is only present after several precast parts 4 have been stacked up and not yet during production. The same is true of concentrated reinforcements 36 shown in reinforcement channels 24 and 24'.

Only the outer mould is shown of mould device 54 because the inner mould for fashioning inner periphery 18 of precast part 4 has a conventional construction. The outer mould shown exhibits three identical second outer mould sections 58. Each first outer mould section 56 comprises an arc extending for slightly less than 120° and two sections 60 protruding radially towards the outside at each end of the arc. Each first outer mould section 56 has a double-walled design with interposed I beams. Adjacent sections 60 of two adjacent outer mould sections 56 are connected to each other by a plate 64 extending perpendicularly to sections 60. At a certain distance inside each plate 64 there is a second mould section 58 in the form of a plate bent inwardly at its side ends less at 45°, its two side ends touching the two adjacent sections 60. Plate 64 exhibits a taphole through which a screw 66 is screwed, the inner end of which engages with the correlating second mould section 58. By turning the screw, one can adjust each particular second mould section 58 so as to be radially more on the outside or more on the inside. Thus, precast parts 4 with varying radial rib width a may be produced in an especially easy manner.

Mould device 54 shown in FIG. 8 differs from that shown in FIG. 7 mainly in that it has a form suitable for producing a precast part 4 having four ribs 28, as shown in a similar form in FIG. 4. The four first mould sections 56 each comprise five areas which link up together at an angle. What was said in connection with FIG. 7 holds analogously for the arrangement and adjustability of second mould sections 58.

Second mould sections 58 may be on a slant so as to approach each other towards the top; the extent of this slant may be adjustable.

Precast parts 4 may each be cast in several, in particular two, parts and then connected together when the structure is assembled.

We claim:

1. A high, self-supporting smokestack or tower having a structure constructed by stacking precast reinforced concrete sections one upon the other, the cross-sectionanl area of the structure being larger at the bottom than at the top concentrated reinforcement being provided along the length of the structure to bear horizontal forces acting on the smokestack or tower, characterized in that the structure exhibits ribs (28) provided with concentrated reinforcement (36) and extending longitudinally on the outside of the structure at least along its lower portion, the radial extent of these ribs (28) increasing from the top to the bottom at lease so as to correspond essentially to the bending moment progression resulting from the horizontal forces and wherein the smokestack or tower includes a central shaft of the structure which has a cross-section which remains constant from the top to the bottom.

2. A high, self-supporting smokestack or tower having a structure constructed by stacking precast reinforced concrete sections one upon the other, the cross sectional area of the structure being larger at the bottom than at the top and concentrated reinforcement being provided along the length of the structure to bear horizontal forces acting on the smokestack or tower, characterized in that the structure exhibits ribs (28) provided with concentrated reinforcement (36) and extending longitudinally on the outside of the structure at least along its lower portion, the radial extent of these ribs (28) increasing from the top to the bottom at least so as to correspond essentially to the bending moment progression resulting from the horizontal forces and further including channels formed in the concrete sections for receiving the concentrated reinforcements of the ribs and of the shaft and for receiving concrete (44) poured in the channels to surround the concentrated reinforcements (36) of the ribs and shaft, the channels further having recesses of a predetermined geometric shape in the walls thereof into which recesses the concrete flows whereby, upon hardening of the concrete, projections (52) are formed anchoring the concentrated reinforcements to the sections.

* * * * *